US007810557B2

(12) United States Patent
Ives et al.

(10) Patent No.: US 7,810,557 B2
(45) Date of Patent: Oct. 12, 2010

(54) COLLET ADAPTER FOR A MOTOR SHROUD

(75) Inventors: Jason B. Ives, Broken Arrow, OK (US); Christopher Marvin Brunner, Owasso, OK (US); Van J. McVicker, Collinsville, OK (US)

(73) Assignee: Baker Hughes Incorporated, Houston, TX (US)

( * ) Notice: Subject to any disclaimer, the term of this patent is extended or adjusted under 35 U.S.C. 154(b) by 451 days.

(21) Appl. No.: 11/844,424

(22) Filed: Aug. 24, 2007

(65) Prior Publication Data

US 2009/0053080 A1 Feb. 26, 2009

(51) Int. Cl.
*E21B 43/12* (2006.01)

(52) U.S. Cl. ..... 166/105; 417/423.3

(58) Field of Classification Search ..... 166/312, 166/367, 105, 105.5, 385, 66.4; 417/423.3, 417/410.1

See application file for complete search history.

(56) References Cited

U.S. PATENT DOCUMENTS 5,271,725 A * 12/1993 Freet et al. ..... 417/423.3
7,188,669 B2 3/2007 Bullock et al.
7,231,982 B2 * 6/2007 Sloan et al. ..... 166/378
2006/0245957 A1 * 11/2006 Berry et al. ..... 417/423.3
2008/0066920 A1 * 3/2008 Allcorn et al. ..... 166/312
2009/0065202 A1 * 3/2009 Brown et al. ..... 166/267
2009/0223662 A1 * 9/2009 Shaw et al. ..... 166/250.15
2009/0266561 A1 * 10/2009 Cobb ..... 166/385
2009/0272538 A1 * 11/2009 Kennedy ..... 166/369

* cited by examiner

*Primary Examiner*—Daniel P Stephenson
(74) *Attorney, Agent, or Firm*—Fellers, Snider, Blankenship, Bailey & Tippens, P.C.

(57) ABSTRACT

An electrical submersible pump assembly (ESP) includes a pump section, a motor section, and a seal section. In one embodiment, an exterior of the pump section defines a gripping indentation above the pump intake. Alternatively, a clamp member may be provided that surrounds the pump, wherein the clamp member defines the gripping indentation. A collet adapter is affixed to an upper end of a shroud. The collet adapter has gripping members that engage the gripping indentation for attaching the shroud to the electrical submersible pump assembly. The collet adapter is provided to ease installation of the motor shroud onto the ESP as well as to ease removal of the motor shroud from the ESP. The collet adapter of the present invention eliminates precise alignment and bolt-on requirements of typical motor shroud mounting techniques.

16 Claims, 5 Drawing Sheets

COLLET ADAPTER FOR A MOTOR SHROUD

FIELD OF THE INVENTION

The present invention relates generally to electrical submersible pumps for producing well fluids. More particularly, the present invention relates to a collet adapter for removably attaching a motor shroud to an electrical submersible pump assembly.

BACKGROUND OF THE INVENTION

A typical electrical submersible pumping unit consists of an electric motor, a seal section, a multistage centrifugal pump having an appropriate intake section, a round and/or flat power cable, a motor lead extension, a motor controller and a power transformer. In addition to the basic equipment, depending on the application, several accessories may be required, such as tubing joints and couplings, swage nipples, cable guards, clamps, reels and supports, a check valve, a drain valve, centralizers, down hole pressure and temperature sending instrumentation systems, etc.

The equipment, basic as well as accessories, is available in various sizes and types to meet different application requirements. Variables include casing size, production rate, total lift, available power supply and environmental and safety regulation. The equipment can be modified, assembled and installed in different ways giving rise to different configurations/installations for various applications.

In one configuration, a unit is set in or below a perforation zone. Motor cooling is achieved by surrounding the motor housing with a shroud or motor jacket up to just above the pump intake. The motor jacket can be either open ended or packed off using a stinger. The length of the shroud is such as to completely cover the pump intake, seal section and motor. The produced fluid in this case is directed from the perforations downwards along an outer diameter of the shroud. The fluid is further routed to the pump intake through an annular space between a motor outer diameter and a shroud inner diameter. The motor shroud is often selected in applications to either increase fluid velocity past the motor for cooling purposes, or as a gas separator when placed below the perforations. The gas separation process uses the natural buoyancy of the fluid for separation. It is also possible to invert the shroud and install the unit above the perforations wherein the shroud is used as a gas separator.

Common practice for affixing the motor shroud to the electrical submersible pump assembly is to bolt the shroud onto the pump while the pump assembly is hanging from the rig. Next, a split ring is bolted to the shroud to seal off the upper portion of the shroud. This procedure requires precise alignment of the pump assembly and motor shroud, as well as dexterity to thread in the bolts. Further, this process can be difficult to implement with gloved hands. Bolts can accidentally be dropped down the hole. Therefore, it is desirable to provide a method and apparatus for facilitating ease of installation and removal of a motor shroud on an electrical submersible pump assembly.

SUMMARY OF THE INVENTION

An electrical submersible pump assembly includes a pump section having a pump defining a pump intake, and a motor section operatively connected to the pump section for driving the pump. A seal section is adjacent to the motor section. An exterior of the pump section defines a gripping indentation above the pump intake. Alternatively, a clamp member may be provided that surrounds the pump, wherein the clamp member defines the gripping indentation. A shroud surrounds the motor section and seal section.

A collet adapter is affixed to an upper end of the shroud. The collet adapter has gripping members that engage the gripping indentation for attaching the shroud to the electrical submersible pump assembly.

The collet adapter is provided to ease installation of a motor shroud onto a submersible pump as well as to ease removal of the motor shroud from a submersible pump. The collet adapter of the present invention eliminates both the precise alignment and bolt-on requirements of typical motor shroud mounting techniques.

In use, the collet adapter of the present invention is attached to the top of a motor shroud that is secured at the well head. The pump assembly is then lowered through the secured motor shroud until the collet adapter snaps into the gripping indentation, such as a circumferential groove, defined by the pump or, alternatively, by a clamping member secured to the pump. The pump assembly, with the attached shroud, may then be lowered into the well.

To remove the shroud from the electrical submersible pump assembly, the pump assembly is pulled to the surface and the motor shroud is again secured at the well head. Screws are run into each release screw orifice defined by each finger of the collet adapter to unsnap the collet. The pump assembly may then be then be pulled out of the motor shroud.

DETAILED DESCRIPTION OF THE PREFERRED EMBODIMENTS

Figure 1:
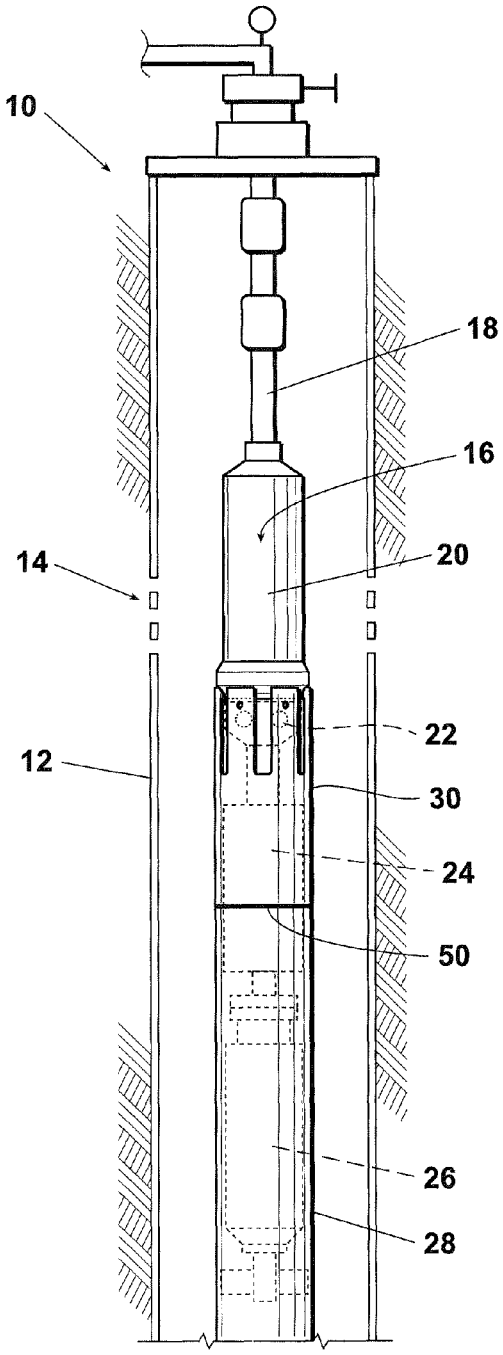
FIG. 1 is an elevational view of an electrical submersible pump assembly with a motor shroud attached to the electrical submersible pump via a collet adapter of the invention, wherein the electrical submersible pump assembly is deployed in a well.
Figure 9:
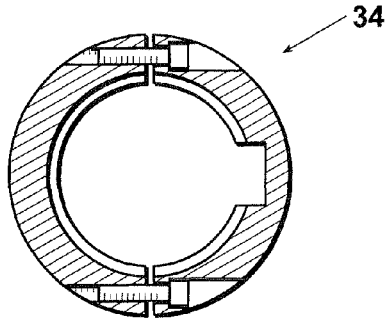
FIG. 9 is a cross-sectional view of the clamp member of FIGS. 7 and 8 taken along line 9-9 of FIG. 8.
Figure 7:
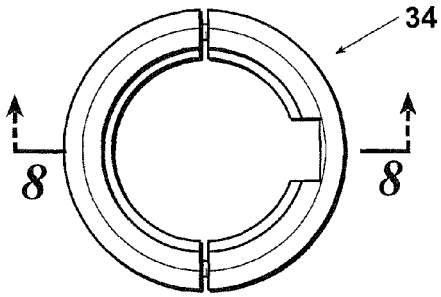
FIG. 7 is a top view of the clamp member of FIGS. 1 and 3.
Figure 8:
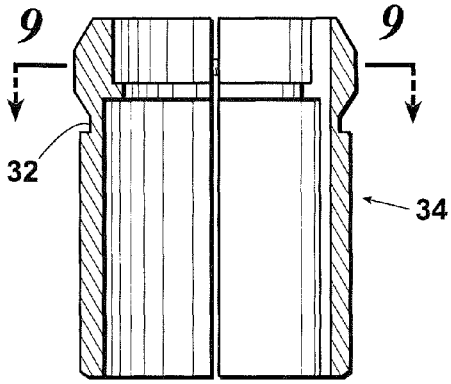
FIG. 8 is a cross-sectional view of the clamp member of FIG. 7 taken along lines 8-8 of FIG. 7.

Referring first to FIG. 1, shown is a well 10 wherein casing 12 surrounds the well bore. Perforations 14 are made in the casing to allow an influx of well fluids. An electrical submersible pump assembly 16 is lowered into well 10 on tubing 18. Electrical submersible pump assembly 16 includes pump 20 having pump intakes 22 for drawing in well fluids. A seal section 24 separates pump 20 from motor 26. A motor shroud 28 may be used to direct the flow of well fluids if the electrical submersible pump assembly 16 is positioned below casing perforations 14. In this configuration, well fluids flow down from the perforations 14 around a bottom edge of motor shroud 28 where the fluid flow may be directed past motor 26 for cooling the motor before the well fluids enter pump intakes 22. Well fluids are then pumped to the surface by pump 20 through tubing 18. Motor shroud 28 is affixed to pump 20 with collet adapter 30, which is discussed in greater detail in reference to FIGS. 2-6.

Figure 2:
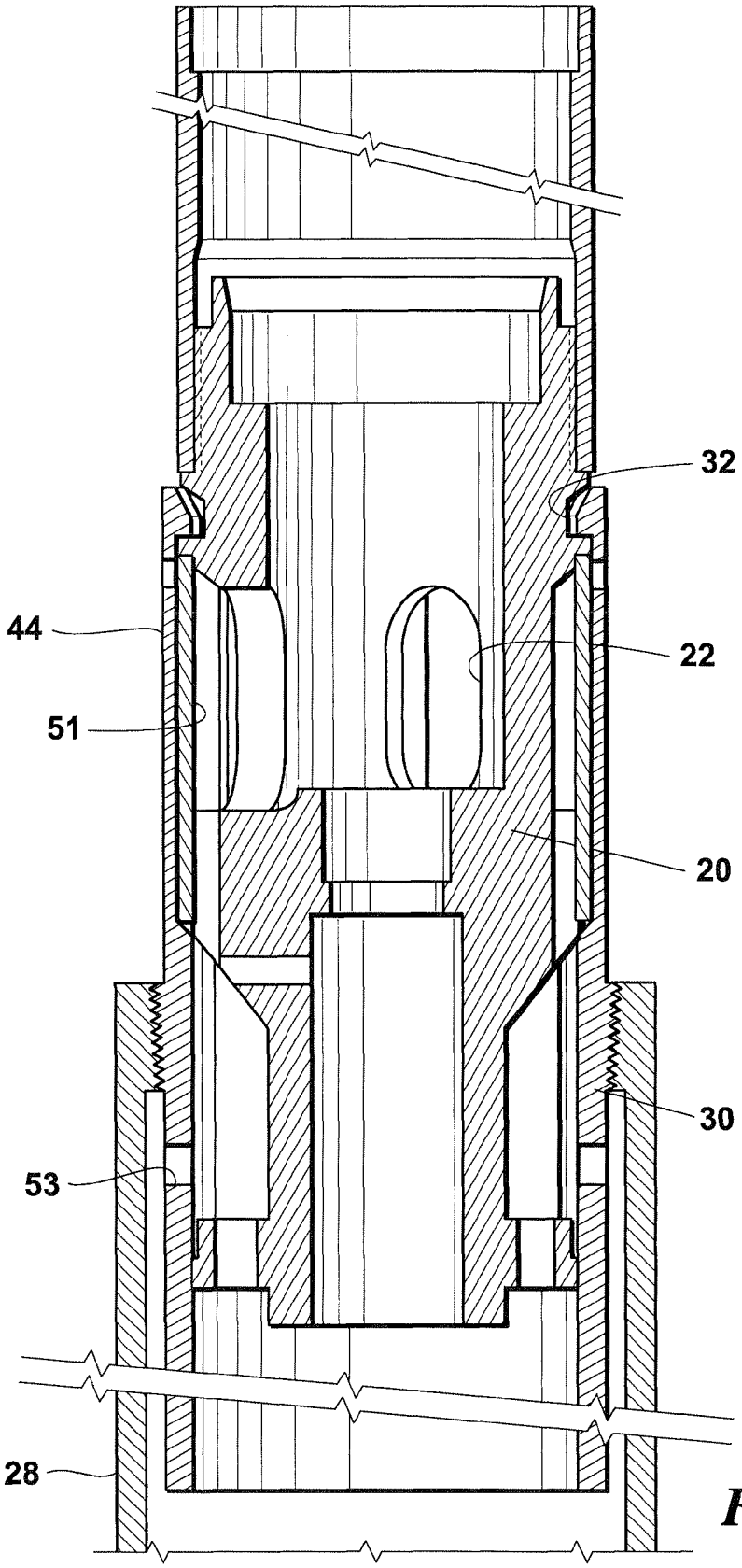
FIG. 2 is a cross-sectional view of a second embodiment of a collet adapter installed on a pump of an electrical submersible pump assembly.
Figure 3:
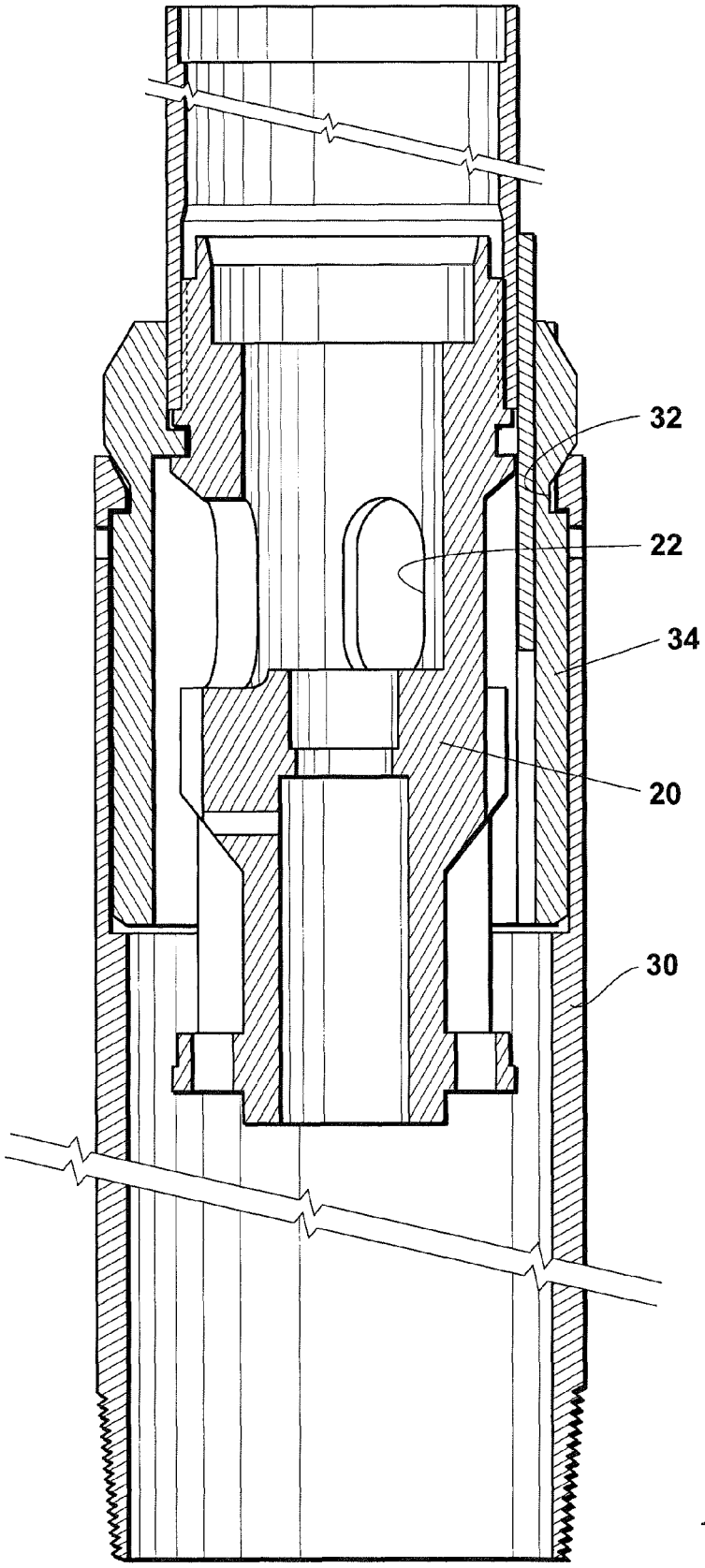
FIG. 3 is a cross-sectional view of the collet adapter installed on a clamp member that is secured to a pump of an electrical submersible pump assembly.

In one embodiment, shown in FIG. 2, pump 20 may define a gripping indentation, such as circumferential groove 32 on an exterior of pump 20. Alternatively, circumferential groove 32 may be formed in a clamp member 34 (FIGS. 3, 7-9). Circumferential groove 32 is preferably located above pump intakes 22, as shown in FIG. 1.

Collet adapter 30 is attached to an upper end of motor shroud 28. Preferably, collet adapter 30 is threadably affixed to motor shroud 28.

Figure 4:
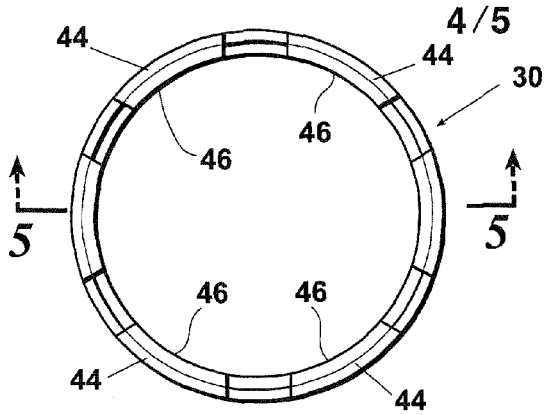
FIG. 4 is a top view of the collet adapter of the invention.
Figure 5:
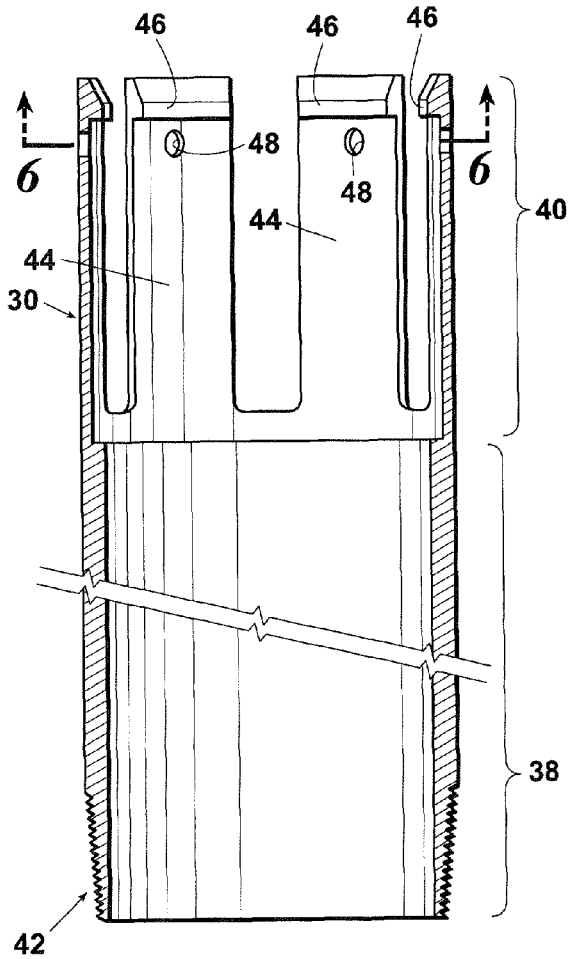
FIG. 5 is a cross-sectional view of the collet adapter of FIG. 4 taken along lines 5-5 of FIG. 4.
Figure 6:
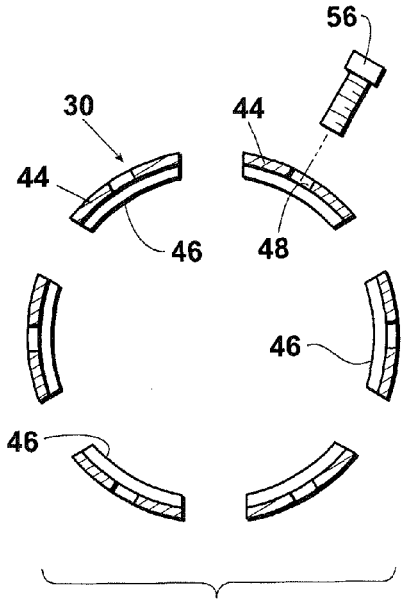
FIG. 6 is a cross-sectional view of the collet adapter of FIGS. 4 and 5 taken along line 6-6 of FIG. 5.

Referring now primarily to FIGS. 4-6, in a preferred embodiment, collet adapter 30 has a length of 24 inches. Collet adapter 30 is made up of a body section 38, a finger section 40, and a threaded lower end 42. Body section 38 preferably has an inner diameter of 4.95 inches and an outer diameter of 5.50 inches. Finger section 40 has an upper end having an inner diameter of approximately 5.25 inches and an outer diameter of 5.5 inches.

Finger section 40 of collet adapter 30 preferably defines six fingers 44, which are equally spaced about a circumference of collet adapter 30. Fingers 44 are preferably separated by a one inch gap between fingers 44. Fingers 44 preferably have a length of 5.5 inches and define raised inwardly facing gripping members 46 that are proximate a distal end of fingers 44. Gripping members 46 preferably have an inner diameter of 4.95 inches and an outer diameter of 5.50 inches. Gripping members 46 preferably have a 30 degree taper that tapers down towards a distal end of fingers 44. Each of said fingers 44 define a release screw orifice 48 centered beneath gripping members 46 of fingers 44.

Referring back to FIG. 1, motor shroud 28 is affixed to a lower end of collet adapter 30. Preferably, upper end 50 of motor shroud 28 is threaded for threadably engaging threaded lower end 42 of collet adapter 30.

Referring back to FIG. 2, collet sleeve 51 my be located inside of collet adapter 30 to prevent fluids from passing between collet fingers 44. In this embodiment, collet adapter 30 is provided with external threads and a fluid passageway 53. The external threads are provided so that an oversized shroud 28 may be threadably attached thereto so that fluid flow may pass around the bolt flange of pump 20. Fluid passageways 53 are provided to provide a flow path to pump intakes 22.

Figure 10:
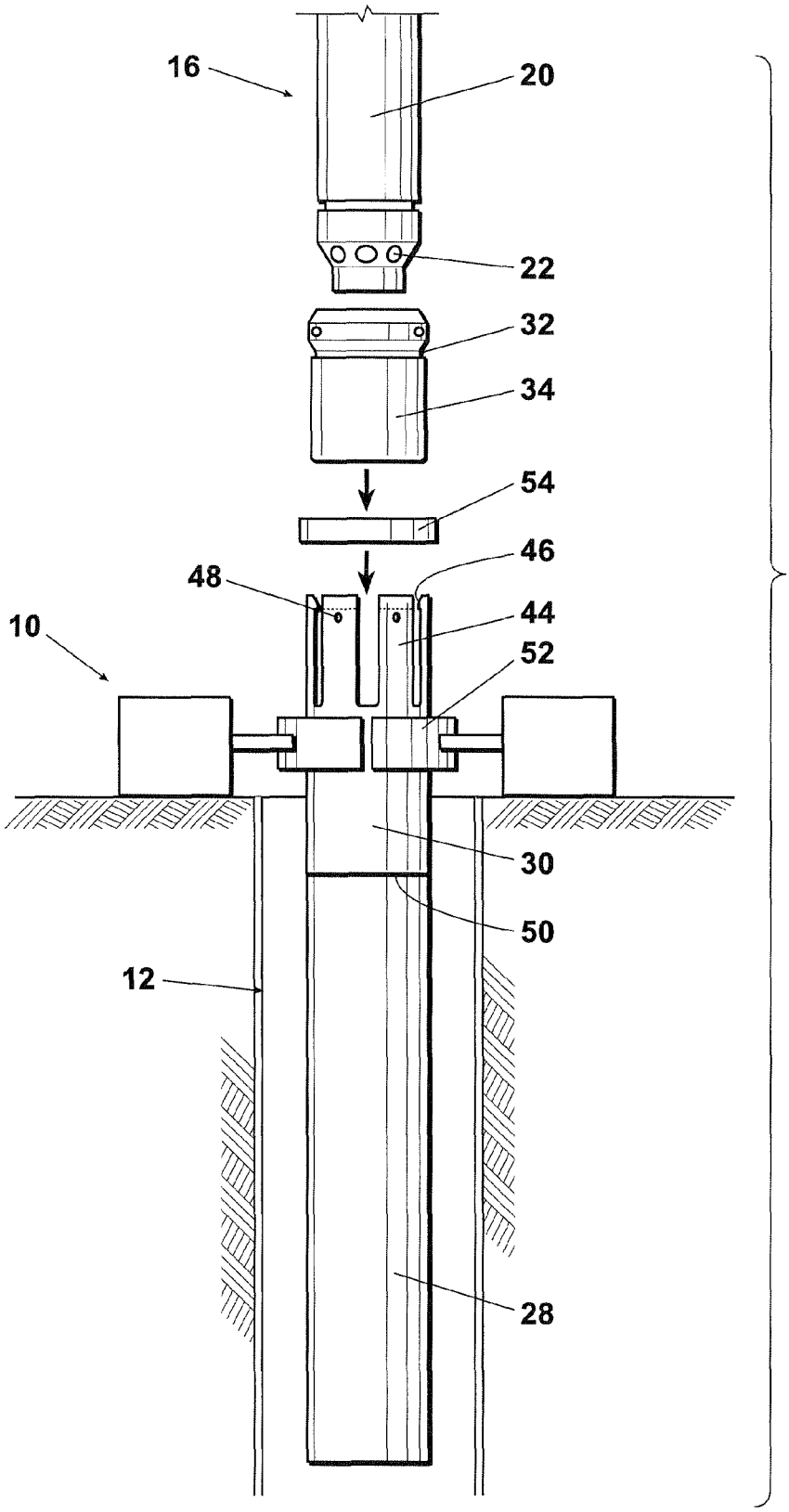
FIG. 10 is an exploded view of the electrical submersible pump assembly of FIG. 1 wherein a clamp member is shown disassembled from the electrical submersible pump assembly and the collet adapter/shroud is shown secured at the wellhead.

In practice, motor shroud 28 may be installed onto an electrical submersible pump assembly 16 in the following manner. Referring now primarily to FIG. 10, a clamp member 34 is affixed to an exterior of electrical submersible pump assembly 16. Clamp member 34 is preferably of a bolt-on configuration, although other attachment methods are contemplated. Clamp member 34 defines exterior circumferential groove 32. Clamp member 34 preferably also serves to block flow past collet fingers 44 downhole after installation is complete. If pump 20 is provided with a suitable gripping indentation, e.g., circumferential groove 32, as shown in FIG. 2, then the step of affixing the clamp member 34 will not be necessary. However, collet sleeve 51 and oversized shroud 28 will need to be installed as described above.

Pump assembly 16 is hung from a rig. Upper end 50 of motor shroud 28 is affixed to collet adapter 30. Collet adapter 30 and motor shroud 28 are then supported at the well head by wellhead clamp 52 or by other suitable means. Pump assembly 16 is then lowered through motor shroud 28 and collet adapter 30 until gripping members 46 of collet fingers 44 on collet adapter 30 snap into the exterior circumferential groove 32, which may be defined by exterior of pump 20 (FIG. 2) or, alternatively, may be provided by clamp 34, as explained above, and which is shown in FIGS. 3 and 10. Cable band 54 (FIG. 10) may then be placed around fingers 44 of collet adapter 30 to ensure positive retention of the motor shroud 28 onto the electrical submersible pump assembly 16. At this time, the collet adapter 30 and motor shroud 28 are released from the well head to allow motor shroud 28 and collet adapter 30 to hang from pump assembly 16. Pump assembly 16 may then be lowered into the well.

To remove motor shroud 28 from electrical submersible pump assembly 16, pump assembly 16 is pulled to the surface. The motor shroud 28 and collet adapter 30 are then again secured at the well head. If cable band 54 has been installed, then cable band 54 should be cut off at this time. Release screws 56 (FIG. 6) are then threaded into release screw orifices 48 of fingers 44 on collet adapter 30 to force fingers 44 outwardly, thereby releasing gripping members 46 from exterior circumferential groove 32. Pump assembly 16 may then be pulled out of motor shroud 28.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. An electrical submersible pump assembly comprising:
- a pump section having a pump defining an pump intake;
- a motor section operatively connected to said pump section for driving said pump;
- a seal section adjacent said pump section;
- a gripping indentation proximate said pump section above said pump intake;
- a shroud surrounding said motor section;
- a collet adapter affixed to an upper end of said shroud, said collet adapter having gripping members for engaging said gripping indentation for attaching said shroud to the pump section;
- wherein said pump section further comprises:
- a clamp member surrounding said pump, said clamp member defining said gripping indentation.

2. The electrical submersible pump according to claim 1 wherein:
- said clamp member is affixed to said pump with bolts.

3. The electrical submersible pump according to claim 1 wherein said collet adapter and said shroud are threadably connected to one another.

4. An electrical submersible pump assembly comprising:
- a pump section having a pump defining an pump intake;
- a motor section operatively connected to said pump section for driving said pump;
- a seal section adjacent said pump section;
- a gripping indentation proximate said pump section above said pump intake;
- a shroud surrounding said motor section;

a collet adapter affixed to an upper end of said shroud, said collet adapter having gripping members for engaging said gripping indentation for attaching said shroud to the pump section;

wherein said gripping members protrude from a plurality of fingers defined by said collet adapter; and wherein each of said plurality of fingers define a release screw orifice.

5. An electrical submersible pump assembly comprising:

a pump section having a pump defining an pump intake;

a motor section operatively connected to said pump section for driving said pump;

a seal section adjacent said pump section;

a gripping indentation proximate said pump section above said pump intake;

a shroud surrounding said motor section;

a collet adapter affixed to an upper end of said shroud, said collet adapter having gripping members for engaging said gripping indentation for attaching said shroud to the pump section;

a collet sleeve located inside of said collet adapter.

6. A method of interacting a shroud with an electrical submersible pump assembly comprising the steps of:

defining a gripping indentation on the electrical submersible pump assembly;

attaching a collet adapter onto an upper end of a shroud, said collet adapter defining gripping members;

supporting said shroud on a structure;

lowering the electrical submersible pump assembly through said collet adapter and attached shroud;

engaging said gripping indentation with said gripping members;

releasing said shroud from said structure;

suspending said shroud from said electrical submersible pumping assembly via said collet adapter.

7. The method according to claim 6 wherein said step of defining a gripping indentation comprises defining a circumferential groove.

8. The method according to claim 6 wherein said step of defining a gripping indentation comprises:

forming said gripping indentation on an exterior surface of a pumping unit.

9. The method according to claim 6 wherein said step of defining a gripping indentation comprises:

affixing a clamp member to a pumping unit, wherein said clamp member defines said gripping indentation.

10. The method according to claim 9 wherein said step of affixing a clamp member comprises a step of:

affixing said clamp member to said pumping unit with bolts.

11. The method according to claim 6 wherein said step of engaging said gripping indentation with said gripping members comprises the steps of:

forcing said gripping members outwardly during said step of lowering the electrical submersible pump assembly through said collet adapter and attached shroud, wherein each of said gripping members are mounted proximate a distal end of one of a plurality of fingers projecting upwardly from said collet adapter; and snapping said gripping members into said gripping indentation.

12. The method according to claim 6 further comprising a step of:

placing a cable band around said gripping members of said collet adapter to ensure positive retention of said gripping members within said gripping indentation.

13. The method according to claim 6 further comprising the step of:

supporting said shroud at the well-head;

running a bolt into a release screw orifice defined by said collet adapter to disengage said gripping members from said gripping indentation;

pulling the electrical submersible pump assembly out of said collet adapter and attached shroud.

14. The method according to claim 13 wherein:

said step of running a bolt into said release screw orifice forces an upwardly projecting finger of said collet adapter outwardly to permit disengagement of said gripping member from said gripping indentation.

15. The method according to claim 6 wherein said step of attaching a collet adapter onto an upper end of said shroud comprises:

threadably connecting said collet adapter and said shroud.

16. A well comprising:

casing;

an electrical submersible pump lowered in said casing on a tubing string, said electrical submersible pump comprising:

a pump section having a pump defining an pump intake;

a motor section operatively connected to said pump section for driving said pump;

a seal section adjacent said pump section;

wherein an exterior of said pump section defines a gripping indentation above said pump intake;

a shroud surrounding said motor section;

a collet adapter affixed to an upper end of said shroud, said collet adapter having gripping members for engaging said gripping indentation for attaching said shroud to the electrical submersible pump; wherein said gripping indentation is a circumferential groove; and further comprising a clamp member surrounding said pump, said clamp member defining said gripping indentation.

* * * * *